United States Patent [19]

Boyce

[11] Patent Number: 4,795,030

[45] Date of Patent: Jan. 3, 1989

[54] CARRYING CASE FOR MUSICAL INSTRUMENTS

[75] Inventor: Timothy Boyce, Sea Bright, N.J.

[73] Assignee: Kramer Music Products, Inc., Neptune, N.J.

[21] Appl. No.: 137,956

[22] Filed: Dec. 24, 1987

[51] Int. Cl.[4] ..... A45C 11/00

[52] U.S. Cl. ..... 206/314; 206/14; 190/108; 224/910

[58] Field of Search ..... 206/14, 314, 317; 150/52 R, 52 C, 52 G; 190/108; 224/910, 913; 273/74; D3/36

[56] References Cited

U.S. PATENT DOCUMENTS

| | | | |
|---|---|---|---|
| D. 245,456 | 8/1977 | Barrett | D3/36 |
| D. 274,101 | 6/1984 | Silk | 190/108 |
| 1,084,360 | 1/1914 | Rahm | 190/108 |
| 1,772,308 | 8/1930 | Ezzelle . | |
| 1,974,156 | 9/1934 | Hockmeyer | 150/52 |
| 1,986,393 | 1/1935 | Geib | 150/52 |
| 2,250,388 | 7/1941 | Mickelberg | 280/11.37 |
| 2,270,049 | 1/1942 | Greenstein | 150/52 G |
| 2,455,296 | 11/1948 | Current | 224/2 |
| 2,737,136 | 3/1956 | Ryder | 206/317 |
| 3,000,417 | 9/1961 | Goldstein | 150/52 R |
| 3,122,225 | 2/1964 | Wand | 190/108 |
| 3,948,302 | 4/1976 | Kohls | 150/52 |
| 4,023,800 | 5/1977 | Haggerty | 150/52 G |
| 4,063,581 | 12/1977 | Williams | D3/36 |
| 4,096,929 | 6/1978 | Frey et al. | 150/52 G |
| 4,151,909 | 5/1979 | Markov | 206/314 |
| 4,378,881 | 4/1983 | de Vries | 206/314 |
| 4,433,781 | 2/1984 | Hummel | 206/314 |
| 4,530,178 | 7/1985 | Rauscher | 150/52 R |

FOREIGN PATENT DOCUMENTS

| | | | |
|---|---|---|---|
| 677849 | 6/1929 | France | 206/14 |
| 18096 | of 1888 | United Kingdom | 206/14 |
| 621924 | 4/1949 | United Kingdom | 190/108 |

*Primary Examiner*—David T. Fidei

*Attorney, Agent, or Firm*—Lerner, David, Littenberg, Krumholz & Mentlik

[57] ABSTRACT

A dual carrying case for two generally trapezoidally-shaped musical instruments is disclosed. The carrying case comprises a pair of generally trapezoidally-shaped pouch members, each of which is longitudinally elongate and includes a generally transversely extending wide end, a generally transversely extending narrow end, and first and second generally longitudinally extending side edges. The pouch members are each adapted to receive and enclose a musical instrument therein, and each pouch member includes means thereon engageable with means on the other of the pouch members for releasably fastening one of the pouch members to the other of the pouch members, with the narrow end of each of the pouch members positioned parallel to, facing and adjacent to the wide end of the other of the pouch members.

15 Claims, 2 Drawing Sheets

CARRYING CASE FOR MUSICAL INSTRUMENTS

BACKGROUND OF THE INVENTION:

This invention relates to carrying cases for musical instruments and, more particularly, to separable, dual carrying cases for pairs of stringed instruments (e.g., guitars), wherein two encased instruments are carried in face to face relationship, with the base of one instrument positioned adjacent to the neck of the other instrument, and vice versa.

Musicians who play stringed musical instruments such as guitars, ukuleles, mandolins, etc., frequently carry with them pairs of instruments in order to be able to rapidly switch from one instrument to another in the event of damage (e.g., string breakage) during a performance, or in order to have two different types of stringed instruments available for use. Stringed instruments, in general, are trapezoidally-shaped with wide bases and narrow necks. Accordingly, carrying cases for these instruments have a similar arrangement and, when more than one instrument case has to be carried by a musician, it results in a bulky, awkward load to be carried. This is particularly true since most conventional carrying cases for instruments are made of a heavy, crush-proof material that significantly enlarges the volume of the carrying case.

It is therefore, a primary object of the present invention to provide an improved carrying case for musical instruments which overcomes the disadvantages associated with earlier types of carrying cases.

Another object of the present invention is to provide an improved dual carrying case for two trapezoidally-shaped musical instruments, wherein the instruments are carried in face to face relationship within separate parts of the carrying case, with the wide end of one instrument positioned adjacent to the narrow end of the other.

Yet another object of the present invention is to provide an improved dual carrying case for trapezoidally-shaped musical instruments, wherein the dual carrying case may be quickly separated into separate individual carrying cases.

Further objects and advantages of this invention will become apparent as the following description proceeds.

SUMMARY OF THE INVENTION

Briefly stated, and in accordance with one embodiment of this invention, a carrying case for musical instruments is provided which comprises a pair of generally trapezoidally-shaped pouch members, each of which is longitudinally elongate and includes a generally transversely extending wide end, a generally transversely extending narrow end, and first and second generally longitudinally extending side edges. The pouch members are each adapted to receive and enclose a musical instrument therein, and each pouch member includes means thereon engageable with means on the other of the pouch members for releasably fastening one of the pouch members to the other of the pouch members, with the narrow end of each of the pouch members positioned parallel and adjacent to the wide end of the other of the pouch members.

BRIEF DESCRIPTION OF THE DRAWINGS:

While the specification concludes with claims particularly pointing out and distinctly claiming the subject matter regarded as the invention herein, it is believed that the present invention will be more readily understood from the following description, taken in conjunction with the accompanying drawings, in which:

Figure 1:
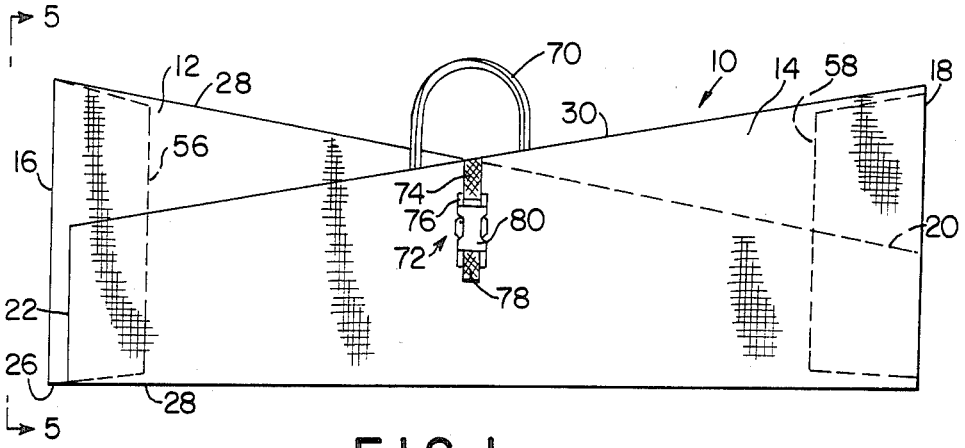
FIG. 1 is a side elevational view of a carrying case for musical instruments in accordance with the present invention, wherein the carrying case has been folded together and secured so as to be ready for transport.

Referring to the figures, the carrying case, shown generally at 10, includes first and second generally trapezoidally-shaped pouch members 12 and 14, respectively. Each of the pouch members 12 and 14 is longitudinally elongate. The pouch members 12 and 14 include respective generally transversely extending wide ends 16 and 18, respectively, and generally transversely extending narrow ends 20 and 22, respectively. The pouch members 12 and 14 also include respective first generally longitudinally extending side edges 24 and 26, and respective second generally longitudinally extending side edges 28 and 30.

Each of the pouch members 12 and 14 includes a respective means thereon, shown generally at 32 and 34, that is engageable with the corresponding means on the other of the pouch members, for releasably fastening one of the pouch members to the other of the pouch members with the narrow end of each of the pouch members positioned parallel to and adjacent to the wide end of the other of the members. In the embodiment illustrated the releasable fastening means 32 and 34 comprises a two-part slide fastener, one portion 36 of which is attached to the first side edge 24 of pouch member 12 and the other portion 38 of which is attached to the first side edge 26 of pouch member 14.

Figure 2:
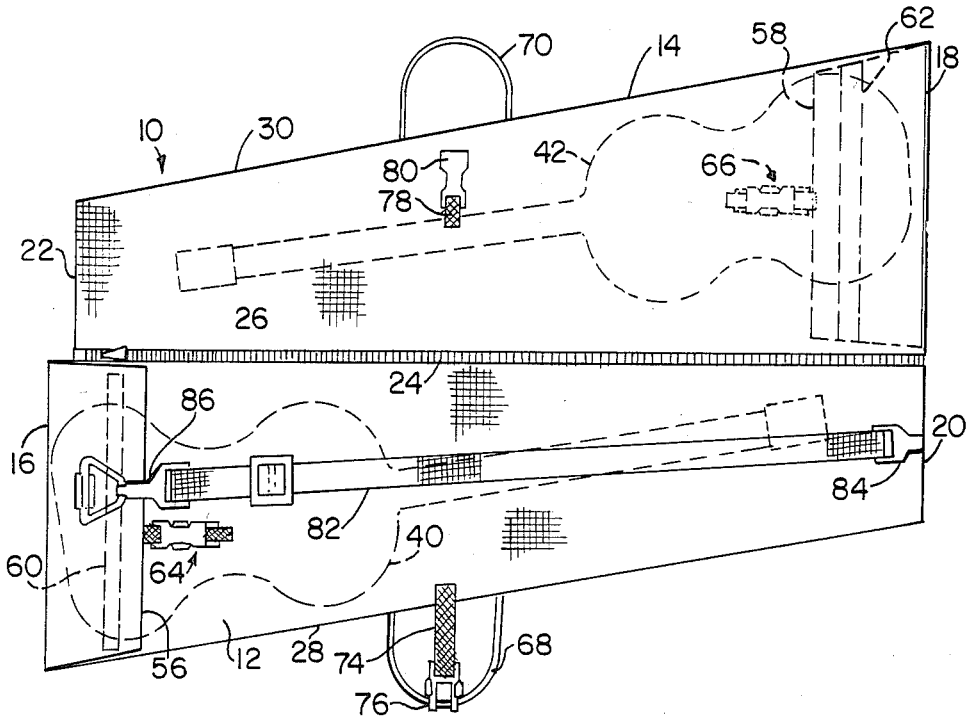
FIG. 2 is an elevational view similar to FIG. 1, with the carrying case partially opened and unfolded so as to show the manner in which the two pouch members thereof are joined together.
Figure 3:
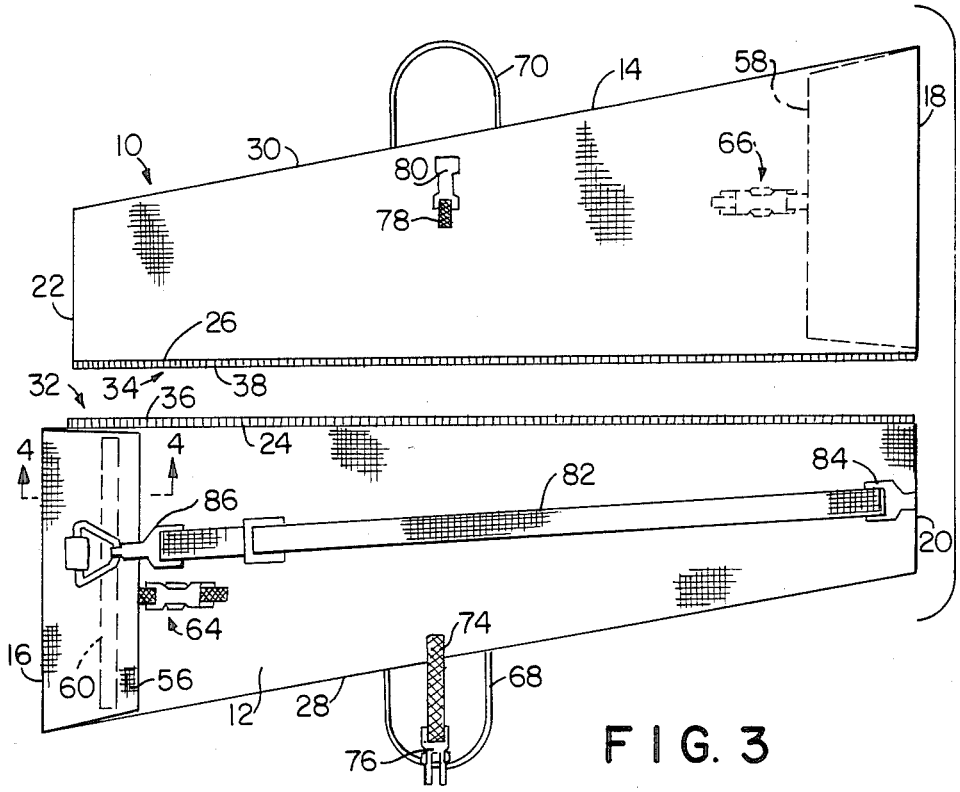
FIG. 3 is a view similar to FIG. 2, with the two pouch members separated from one another.
Figure 4:
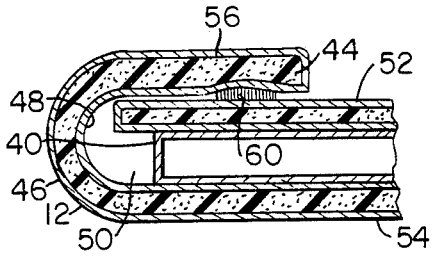
FIG. 4 is an enlarged sectional elevation view, taken along the line 4—4 of FIG. 3, showing a sealing strip employed in closing an end flap of one of the pouch members; and, FIG. 5 is an end elevation view taken along the line 5—5 of FIG. 1.
Figure 5:
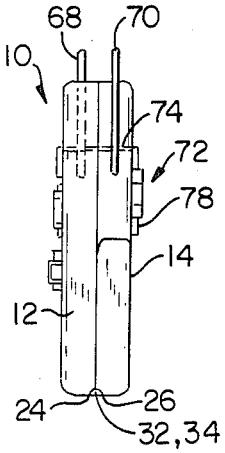

As shown in FIGS. 2 and 4, the interiors of the pouch members 12 and 14 are adapted to receive and enclose therein musical instruments, in this case the respective guitars 40 and 42. The pouch members are preferably made from sheets of a flexible, foamed or expanded cellular elastomeric material, for example the foamed or blown cellular rubber shown at 44 in FIG. 4, which are covered on each of their surfaces with protective fabric coatings 46 and 48. The musical instruments are received in pockets or pouches, one of which is shown at 50 in FIG. 4, formed by the front and rear walls 52 and 54, respectively, of each of the pouch members. The pouch members 12 and 14 are also provided with respective closure flap portions 56 and 58 which sealingly engage the front walls 52 of the pouch members 12 and 14 by means of respective sealing strips 60 and 62 and respective strap and snap lock arrangements, shown generally at 64 and 66.

Carrying handles 68 and 70 are provided on pouch members 12 and 14, respectively, for hand carrying the two pouch members when they have been pivoted about an axis (not shown) parallel to and adjacent to the longitudinal side edges 24 and 26 thereof, into the face to face contact shown in FIG. 1. The handles 68 and 70 are positioned adjacent to and centrally of the second side edges 28 and 30, respectively, of pouch members 12 and 14 so that when the carrying case 10 is pivoted into the position shown in FIG. 1, the weight of the musical instruments being carried therein is balanced relative to handles 68 and 70. A locking arrangement, shown generally at 72 and including a strap 74 and a spring clasp 76 carried by pouch member 12 and a strap 78 and a clamp 80 carried by pouch member 14, is provided to lock the two pouch members in face to face configuration after the pouch members have been pivoted about their side edges 24 and 26.

An adjustable length shoulder strap 82, having one of its ends 84 fastened to the narrow end 20 of pouch member 12 and the other of its ends 86 fastened to the flap 56 at the wide end 16 of pouch member 12, is provided for shoulder-carrying the joined pair of trapezoidally-shaped pouch members.

From the foregoing, it will be seen that an improved dual carrying case has been provided in which two bulky, trapezoidally-shaped, musical instruments are protectively held in respective soft elastomeric pouches, with the wide end of each of the instruments positioned parallel to, facing and adjacent to the narrow end of the other of the instruments. The dual carrying case forms a conveniently carried package in which the weight of the instruments therein is balanced on either side of the carrying handles and in which the individual carrying cases may be separated from one another at the user's option.

While there has been shown and described what is presently considered to be the preferred embodiment of this invention, it will be obvious to those skilled in the art that various changes and modifications may be made without departing from the broader aspects of this invention. For example, the dual carrying case may be used to carry other longitudinally elongate, generally trapezoidal articles than musical instruments. It is, therefore, aimed in the appended claims to cover all such changes and modifications as fall within the true spirit and scope of this invention.

What is claimed is:

1. A carrying case for longitudinally elongate articles having a wide end and a narrow end, said case comprising a pair of generally trapezoidally-shaped pouch members, each of which is longitudinally elongate and includes a generally transversely extending wide end, a generally transversely extending narrow end, and first and second generally longitudinally extending side edges, said pouch members each being adapted to receive and enclose one of said articles therein, and each including means thereon engageable with means on the other of said pouch members for releasably fastening one of said pouch members to the other of said pouch members with the narrow end of each of said pouch members positioned parallel and adjacent to the wide end of the other of said members.

2. A carrying case for longitudinally elongate articles having a wide end and a narrow end, said case comprising a pair of generally trapezoidally-shaped pouch members, each of which is longitudinally elongate and includes a generally transversely extending wide end, a generally transversely extending narrow end, and first and second generally longitudinally extending side edges, said pouch members each being adapted to receive and enclose one of said articles therein, and each including means thereon engageable with means on the other of said pouch members for releasably fastening one of said pouch members to the other of said pouch members with the narrow end of each of said pouch members positioned parallel to, facing and adjacent to the wide end of the other of said members.

3. A carrying case as described in claim 2, wherein said first side edge of said one of said pouch members is positioned adjacent to said first side edge of said other of said pouch members when said releasable fastening means is engaged.

4. A carrying case as described in claim 2, and further including means positioned on at least one of said pouch members for carrying said pouch members when said releasable fastening means is engaged.

5. A carrying case as described in claim 3, and further including means positioned on at least one of said pouch members for carrying said pouch members when said releasable fastening means is engaged.

6. A carrying case as described in claim 5, wherein said pouch member carrying means includes first and second handle members positioned one on each of said pouch members adjacent to and centrally of said second side edges thereof, whereby the weight of the articles being carried in said carrying case is balanced relative to said handles.

7. A carrying case as described in claim 5, wherein said pouch member carrying means includes first and second handle members positioned one on each of said pouch members adjacent to said second side edges thereof, whereby each of said pouch members may be separately carried by one of said handle members when said releasable fastening means is released.

8. A carrying case as described in claim 3, wherein said releasable fastening means comprises a two part slide fastener, one portion of which is attached to said first side edge of said one of said pouch members and the other portion of which is attached to said first side edge of said other of said pouch members.

9. A carrying case as described in claim 8, wherein said pouch member carrying means includes first and second handle members positioned one on each of said pouch members adjacent to and centrally of said second side edges thereof, whereby each of said pouch members may be separately carried by one of said handle members when the two portions of said slide fastener are separated from one another, and whereby the weight of the articles being carried in said carrying case is balanced relative to said handles when the two portions of said slide fastener are joined together.

10. A carrying case for musical instruments, said case comprising a pair of generally trapezoidally-shaped pouch members made of a soft flexible material, each of said pouch members being longitudinally elongate and including a generally transversely extending wide end, a generally transversely extending narrow end, and first and second generally longitudinally extending side edges, said pouch members each being adapted to receive and enclose a musical instrument therein, and each including first means thereon engageable with the other of said pouch members for releasably fastening one of said pouch members to the other of said pouch members with said first side edge of said one pouch member positioned adjacent to said first side edge of said other pouch member and with the narrow end of said one pouch member positioned adjacent to the wide end of said other pouch member, whereby said pouch members may be pivoted relative to one another about an axis generally parallel to and adjacent to said first side edges to a condition wherein the wide end of each of said pouch members is positioned generally parallel to, facing and adjacent to the narrow end of the other of said pouch members, each of said pouch members including second means positioned thereon and engageable with the second means of the other of said pouch members for releasably fastening a portion of each of the pouch members to a portion of the other of the pouch members adjacent the second side edges thereof.

11. A carrying case as described in claim 10, and further including means positioned on at least one of said pouch members for carrying said pouch members when said releasable fastening means are engaged.

12. A carrying case as described in claim 11, wherein said pouch member carrying means includes first and second handle members positioned one on each of said pouch members adjacent to and centrally of said second side edges thereof, whereby the weight of the musical instruments being carried in said carrying case is balanced relative to said handles.

13. A carrying case as described in claim 11, wherein said pouch member carrying means includes first and second handle members positioned one on each of said pouch members adjacent to said second side edges thereof, whereby each of said pouch members may be separately carried by one of said handle members when said releasable fastening means is released.

14. A carrying case as described in claim 11, wherein said releasable fastening means comprises a two part slide fastener, one portion of which is attached to said first side edge of said one of said pouch members and the other portion of which is attached to said first side edge of said other of said pouch members.

15. A carrying case as described in claim 14, wherein said pouch member carrying means includes first and second handle members positioned one on each of said pouch members adjacent to and centrally of said second side edges thereof, whereby each of said pouch members may be separately carried by one of said handle members when the two portions of said slide fastener are separated from one another and said second releasable fastening means is released, and whereby the weight of the musical instruments being carried in said carrying case is balanced relative to said handles when the two portions of said slide fastener are joined together and the second releasable fastening means is fastened.

* * * * *